United States Patent [19]

Izumi et al.

[11] Patent Number: 4,534,850

[45] Date of Patent: Aug. 13, 1985

[54] OPTICALLY ANTISOTROPIC CARBONACEOUS PITCH

[75] Inventors: Takayuki Izumi; Tsutomu Naito; Tomoo Nakamura, all of Saitama, Japan

[73] Assignee: Toa Nenryo Kogyo Kabushiki Kaisha, Tokyo, Japan

[21] Appl. No.: 487,700

[22] Filed: Apr. 22, 1983

Related U.S. Application Data

[62] Division of Ser. No. 321,597, Nov. 16, 1981, abandoned.

[30] Foreign Application Priority Data

Nov. 19, 1980 [JP] Japan ..... 55-162972

[51] Int. Cl.[3] ..... C10C 3/00

[52] U.S. Cl. ..... 208/22; 208/45; 423/447.4; 423/447.6; 264/29.2

[58] Field of Search ..... 423/447.1, 447.2, 447.4, 423/447.6, 447.7, 447.8; 208/22, 45, 44; 264/29.2

[56] References Cited

U.S. PATENT DOCUMENTS

| | | | |
|---|---|---|---|
| 4,017,327 | 4/1977 | Lewis et al. | 423/447.4 |
| 4,197,283 | 4/1980 | Crepaux et al. | 423/447.2 |
| 4,209,500 | 6/1980 | Chwastiak | 208/22 |
| 4,317,809 | 3/1982 | Lewis et al. | 423/447.1 |
| 4,351,816 | 9/1982 | Schulz | 423/447.4 |
| 4,402,928 | 9/1983 | Lewis et al. | 423/447.1 |

FOREIGN PATENT DOCUMENTS

| | | | |
|---|---|---|---|
| 2338357 | 2/1974 | Fed. Rep. of Germany | 423/447.3 |

*Primary Examiner*—William R. Dixon, Jr.
*Assistant Examiner*—Steven Capella
*Attorney, Agent, or Firm*—Joseph J. Dvorak

[57] ABSTRACT

A composition for an optically anisotropic carbonaceous pitch suitable for the production of a carbon material having a high tensile strength and a high modulus of elasticity. The composition comprises about 2 to 20 percent by weight of a first, n-heptane-soluble component, about 15 to 45 percent by weight of an n-heptane-insoluble and benzene-soluble, second component and the balance of the composition including benzene-insoluble components. The composition has a volume ratio of an optically anisotropic phase of at least about 90% and a softening point of up to about 320° C.

12 Claims, No Drawings

OPTICALLY ANTISOTROPIC CARBONACEOUS PITCH

This is a division of application Ser. No. 321,597, filed Nov. 16, 1981, abandoned.

FIELD OF THE INVENTION

The present invention relates to an optically anisotropic carbonaceous pitch suitable for the production of carbon fibers having a high strength and a high modulus of elasticity and carbon materials including other carbonaceous substances, a process for producing the optically anisotropic carbonaceous pitch, carbonaceous pitch fibers and a process for producing carbon fibers from the optically anisotropic pitch.

BACKGROUND OF THE INVENTION

In these days of energy and resource economization, there are eagerly demanded low cost, high performance carbon fibers used for the production of light weight comprise materials having a high tensile strength and a high modulus of elasticity required of aircrafts, motorcars, etc. and also molding carbon materials having a high tensile strength and a high density to be compression-molded to form various articles.

The compositions and structures of optically anisotropic pitches suitable for the production of high performance carbon fibers have not fully been elucidated. Further, a relationship between physical properties of carbonaceous pitches and the structures of compositions thereof has been unclear. There has not yet been completed a technique of stably controlling them on an industrial scale.

In optically anisotropic pitches heretofore disclosed such as those disclosed in the specifications of Japanese Patent Laid-Open Nos. 19127/1974 and 89635/1975, the optically anisotropic phase corresponds substantially to quinoline-insoluble portion (or pyridine-insoluble portion). As the optically anisotropic phase is increased closely to 100%, a softening point thereof is elevated remarkably and the spinning temperature is also elevated to approximately 400° C. or higher, whereby a decomposed gas is formed from the pitch and the polymerization is caused during the spinning operation. Therefore, in the conventional carbon fiber spinning processes, the optically anisotropic phase content is controlled to up to 90% (practically, in the range of 50–65%) and the spinning temperature is controlled to a point at which the thermal decomposition or the thermal polymerization hardly occurs.

However, such a pitch composition is heterogeneous, since it comprises a mixture of an optically anisotropic phase and a considerable content of an optically isotropic phase. Accordingly, it has disadvantages that the fibers are broken during the spinning and the fibers have irregular thicknesses and a low tensile strength.

A pitch disclosed in the specification of Japanese Patent Publication No. 8634/1974 consists of seemingly substantially 100% optically anisotropic phase. This is a special pitch wherein the pitch molecules have limited, specific chemical structures. This pitch is prepared by the thermal polymerization of expensive pure substances such as chrysene, phenanthrene and tetrabenzophenazine and, therefore, constituents thereof have considerably controlled molecular weights. On the other hand, pitches produced from general mixed materials have quite high softening points. A pitch disclosed in the specification of Japanese Patent Publication No. 7533/1978 as a material for the production of carbon fibers has a low softening point and a low spinning temperature and is easily spun but the specification is silent on the optically antisotropic phase content. In said invention, the starting hydrocarbon is polycondensed in the presence of a Lewis acid catalyst such as aluminum chloride, the resulting pitch has specific composition and structure and carbon fibers produce from the pitch have insufficient tensile strength and modulus of elasticity. Said invention has another problem that the complete removal of the catalyst is difficult.

A pitch disclosed in the specification of Japanese Patent Laid-Open No. 55625/1979 is a homogeneous pitch consisting of essentially completely 100% optically anisotropic phase. However, it has a relatively high softening point in spite of narrow molecular weight distribution. In addition, said pitch has a low content of an n-heptane-soluble component (hereinafter referred to as component O) and a low content of an n-heptane-insoluble and benzene-soluble component (hereinafter referred to as component A) as will be described below in detail. Further, quinoline-insoluble component (hereinafter referred to as component C) in the balance of benzene-insoluble component is a large moiety of pitch. Therefore, the conventional pitch has a softening point of higher than about 330° C. and a spinning temperature thereof is as high as 370°–400° C. In this temperature range, it is difficult to spin the pitch stably in an industrial basis.

As described above, known optically anisotropic pitches consisting of nearly 100% optical anisotropic phase have high softening points and they cannot be spun stably. On the other hand, pitches having low softening points (Except those produced from specific starting materials and having specific structures) are heterogeneous and they cannot be spun easily. Thus, it has been difficult to obtain carbon fibers having an excellent crystalloids.

BRIEF SUMMARY OF THE INVENTION

Generally, optically anisotropic pitches have been defined according to a partial chemical structure, average molecular weight or content of quinoline-insoluble component (or pyridine-insoluble component) content. However, these methods are not suitable to define or specify a homogeneous, optically anisotropic pitch composition having a low softening point suitable for the production of high-performance carbon fibers and other carbon materials, because composition of the optically anisotropic pitch comprise mixtures of numerous compounds having complicated, various structures and molecular weights. It cannot, therefore, be specified from the characteristics of merely partial or the whole, average chemical structures, and it cannot be specified from average molecular weights of compositions having molecular weights ranging broadly from several hundreds to several tens of thousands and, in some cases, to a molecular weight close to those of coke.

After intensive investigations made on optically anisotropic pitch compositions suitable for the production of high performance carbon fibers, the inventors have found that an optically anisotropic pitch has a well developed laminate structure of condensed polycyclic aromatic compounds and a high molecular orientation and that actually, there are various optically anisotropic pitches and among them, those having a low softening point and homogeneity suitable for the production of carbon fibers have a specific chemical structure and composition. More particularly, the inventors have found that the compositions, structures and molecular weights of said component O (n-heptane-soluble component) and component A (n-heptane-insoluble and benzene-soluble component) are quite important in the optically anisotropic pitches. More particularly, the inventors have found that a pitch composition containing specific amounts of components O and A can be obtained as a completely optically anisotropic pitch and that an adequate control of the balance of the constituents thereof is an indispensable condition of the optically anisotropic pitch composition for the practical production of high-performance carbon materials. The present invention has been completed on the basis of those findings.

Further, it has been found that an optically anisotropic pitch suitable for the production of a more excellent, high-performance carbon material can be obtained by limiting also benzene-insoluble components [a quinoline-soluble component (hereinafter referred to as component B) and a quinoline-insoluble component (hereinafter referred to a component C)] in the pitch composition in addition to above components O and A.

The present invention has been completed on the basis of the above findings. A principal object of the present invention is to provide an optically anisotropic carbonaceous pitch having a low softening point and suitable for the production of carbon materials having a high tensile strength and a high modulus of elasticity, particularly carbon fibers.

Another object of the present invention is to provide a homogeneous, optically anisotropic pitch having a highly oriented structure suitable for the production of carbon materials having a high tensile strength and a high modulus of elasticity, particularly carbon fibers.

Another object of the present invention is to provide an optically anisotropic carbonaceous pitch having good spinning properties which can be spun at a temperature far lower than a temperature at which the thermal decomposition and polycondensation occur markedly to obtain carbon fibers having a high tensile strength and a high modulus of elasticity.

Still another object of the present invention is to provide an optically anisotropic carbonaceous pitch suitable for the production of carbon materials having a high tensile strength and a high modulus of elasticity by limit the balance of components O and A constituting the pitch.

A further object of the present invention is to provide an optically anisotropic carbonaceous pitch suitable for the production of carbonaceous materials having a higher tensile strength and a higher modulus of elasticity by limiting the balance of components O, A, B and C constituting the pitch.

Another object of the present invention is to provide a process for efficiently producing an optically anisotropic carbonaceous pitch suitable for the production of carbon fibers having a high tensile strength and a high modulus of elasticity.

Another object of the present invention is to provide a process for producing an optically anisotropic carbonaceous pitch suitable for the production of carbonaceous materials having a high tensile strength and a high modulus of elasticity and comprising components O, A, B and C each having specific composition, structure and molecular weight.

Other objects of the present invention are to provide carbonaceous pitch fibers prepared from a new, optically anisotropic carbonaceous pitch having a low softening point, homogeneous composition and an excellent molecular orientation which pitch can be spun at a sufficiently low temperature and also to provide a process for producing carbon fibers having a high tensile strength and a high modulus of elasticity.

DETAILED DESCRIPTION OF THE INVENTION

The present invention relates to a carbonaceous pitch used for the production of a carbon material, particularly carbon fibers characterized by containing as indispensable components about 2–20 wt.% of component O, about 15–45 wt.% of component A and the balance of benzene-insoluble components and having a volume ratio of an optically anisotropic phase of at least about 90% and having a softening point of up to about 320° C., a process for the production thereof, pitch fibers obtained by the melt-spinning of the carbonaceous pitch and a process for the production of carbon fibers from them.

According to inventors' findings, in optically anisotropic (at least 90%) pitches produced by a conventional technique, only quinoline-insoluble component (or pyridine-insoluble component) is important as the principal component or only the quinoline-insoluble component and benzene-insoluble component (components B and C) are the principally important components but contents of components O and A are too low and the pitch has unsuitable spinning characteristics and, therefore, the pitch is not preferred. After further investigations, the inventors have found that the presence of specific amounts of components O and A having the specific characters as described below is indispensable for the suitable pitch composition. The present invention has been completed on the basis of those findings.

The present invention has been completed after investigations wherein various optically anisotropic pitches were prepared, components O and A were then fractionated from the carbonaceous pitches using solvents and relationships between the properties of the respective components or contents of the components and the physical properties, homogeneity and orientation of the whole pitch were examined in detail. The present invention is also based on a finding that important conditions are that the respective components are contained in specific contents which could not be found in the prior art and that the respective components have specific properties. Properties of the constituents of the optically anisotropic pitch having a high orientation, homogeneity and a low softening point required for the production of high-performance carbon fibers include C/H atomic ratio, fa, number average molecular weight, maximum molecular weight (molecular weight taken at a point of 99 wt.% integration from the low molecular weight side) and minimum molecular weight (molecular weight taken at a point of 99% integration from the high molecular weight side) in limited ranges as described below.

Component O has generally properties of very wide ranges. However, component O used in the present invention has a C/H atomic ratio of at least about 1.3, an fa value of at least about 0.80, a number average molecular weight of up to about 1,000 and a minimum molecular weight of at least about 150. Preferably, component O has a C/H atomic ratio of about 1.3–1.6, an fa value of about 0.80–0.95, a number average molecular weight of about 250–700 and a minimum molecular weight of at least about 150.

Component A has generally properties of very wide ranges. However, component A used in the present invention has a C/H atomic ratio of at least about 1.4, an fa value of at least about 0.80, a number average molecular weight of no higher than about 2,000 and a maximum molecular weight of no higher than about 10,000. Preferably, component A has a C/H atomic ratio of about 1.4–1.7, an fa value of about 0.80–0.95, a number average molecular weight of about 400–1,000 and a maximum molecular weight of no higher than about 5,000.

Suitable contents of components O and A are about 2–20 wt. % and about 15–45 wt. %, respectively. The most preferred contents of components O and A are about 5–15 wt. % and about 15–35 wt. %, respectively.

If the C/H atomic ratio and an fa value of component O are lower than the above described ranges or if the content thereof is higher than the above range, the pitch, as a whole, is heterogeneous and contains a considerable amount of isotropic moiety. If the average molecular weight is larger than 700 or the content thereof is lower than the above described range, it is impossible to obtain the pitch having a low softening point. If the C/H atomic ratio or fa value of component A is lower than the above range or if the number average molecular weight thereof is lower than the above range or if the content thereof is higher than the above range, the pitch is a mixture of isotropic and anisotropic moieties in many cases and is heterogeneous as a whole. Further, if the number average molecular weight or the maximum molecular weight is higher than the above range or if proportion of component A in the composition is lower than the above range, the pitch could not have a low softening point, though it is homogeneous and optically anisotropic.

After further investigations, the inventors have found the following fact. Above components O and A are taken in the laminate structure in the optically anisotropic pitch to act as a solvent or plasticizer, thereby exerting influences mainly on fusibility and fluidity of the pitch but, when those components O and A are used alone, they do not exhibit the optical anisotropy and the laminate structure is hardly obtained. However, an optically anisotropic pitch required in the production of high-performance carbon fibers having a particularly high homogeneity and a low softening point can be obtained if components O and A are mixed with benzene-insoluble components B and C which are to be contained in the pitch composition as the balance as described above and which per se are infusible and easily laminating components in contents well-balanced with those of components O and A, and if chemical structural, characteristics and molecular weights of the respective constituting components are covered in the specific ranges.

Namely, high-performance carbon fibers having an improved stability of qualities can be produced from an optically anisotropic carbonaceous pitch containing about 2–20 wt.% of component O, about 15–45 wt.% of component A, about 5–40 wt.% of component B (benzene-insoluble and quinoline soluble component) and about 20–70 wt.% of component C (benzene-insoluble and quinoline-insoluble component) and having a volume ratio of an optically anisotropic phase of at least about 90% and a softening point of no higher than about 320° C.

Components B and C suitable for constituting the melt-spinnable, optically anisotropic pitch should have a C/H atomic ratio, fa value, number average molecular weight and maximum molecular weight (molecular weight taken at a point of 99% integration from the low molecular weight side) in specific ranges which will be shown below.

Component B (benzene-insoluble, quinoline-soluble component) has generally properties of very wide ranges. However, component B used in the present invention has a C/H atomic ratio of at least about 1.5, an fa value of at least about 0.80, a number average molecular weight of up to about 2,000 and a maximum molecular weight of no higher than about 10,000. Preferably, component B has a C/H atomic ratio of about 1.5–1.9, an fa value of about 0.80–0.95 and a number average molecular weight of about 800–2,000. Component C (benzene-insoluble, quinoline-insoluble component) has generally properties of very wide ranges. However, component C used in the present invention has a C/H atomic ratio of up to about 2.3, an fa value of at least about 0.85, an estimated number average molecular weight of no higher than about 3,000 and a maximum molecular weight of no higher than 30,000. Preferably, component C has a C/H atomic ratio of about 1.8–2.3, an fa value of about 0.85–0.95 and a number average molecular weight of about 1,500–3,000.

Content of component B is about 5–55 wt. %, preferably about 5–40 wt. %. Content of component C is about 20–70 wt. %, preferably about 25–65 wt. %.

In a preferred embodiment of the present invention, the above four components constituting the carbonaceous pitch have the above specific characteristics and they are contained in the pitch in the above specific proportion. The details of present invention will be summarized below:

The definition of the term "optically anisotropic phase" used in this is not necessarily unified or standardized in the art or in literatures. The term "optically anisotropic phase" herein indicates a pitch-constituting phase. In case a section of a pitch mass which has been solidified at nearly ambient temperature is polished and then observed by means of a reflection type polarized light microscope under crossed nicol, the part that a sheen is recognized in the sample when the sample or the crossed nicol is rotated is optically anisotropic. The other part in which the sheen is not recognized is optically isotropic phase.

Unlike the optically isotropic phase, the chemically anisotropic phase contains as principal components molecules having chemical structures having a higher flatness of the polycyclic aromatic condensed rings and, therefore, they are coagulated or associated together to form a laminate of the planes. It is thus considered that the optically anisotropic phase stands in the form of a liquid crystal at its melting temperature. Therefore, if the optical anisotropic pitch is extruded through a thin nozzle in the spinning operation, the planes of the molecules are arranged nearly in parallel with the fiber axis and, consequently, the carbon fibers obtained from the optically anisotropic pitch have a high modulus of elasticity. The quantitative determination of the optically anisotropic phase is effected by taking a polarizing microscopic picture thereof under crossed nicol and measuring an area ratio of the optically anisotropic moiety. This is shown substantially by volume percent.

As for the homogeneity of the pitch, a substantially homogeneous, optically anisotropic pitch herein involves a pitch having an optically anisotropic phase content determined as above of 90–100 vol. % in which solid particles (diameter: larger than 1μ) cannot substantially be detected on the section thereof by the reflection type microscopic observation and which is substantially free of foaming due to a volatile matter at a melt spinning temperature, since such a pitch exhibit a high homogeneity in the actual melt spinning operation.

In the present invention, perfect conversion to 100% anisotropic phase is not always necessary, and 1–10% isotropic microsphere included in anisotropic matrix are satisfactory for substantial homogeneity and even effective for low softening point of the pitch and easy to obtain in the practical process by the present invention.

In case a substantially heterogeneous, optically anisotrop pitch containing more than 10% of the optically isotropic phase is spun, it is a tendency that breaking frequency of the fibers is high, the high speed spinning is difficult, fibers of a sufficient thinness cannot be obtained, filament thicknesses are not uniform and, consequently, high performance carbon fibers cannot be obtained, since the pitch comprises a mixture of the optically anisotropic phase having a high viscosity and a large moiety of optically isotropic phase having a low viscocity.

If the pitch contains infusible solid, fine particles or low molecular weight volatile substances, the spinnability thereof is inhibited during the melt spinning operation and the pitch fibers thus obtained contains air bubbles or solid extraneous matters which invite various troubles.

The term "softening point of pitch" herein indicates a temperature at which the solid pitch is converted into liquid pitch. This is determined from a peak temperature of a latent heat absorbed or released when the pitch is molten or solidified measured by means of a differential scanning type calorimeter. This temperature coincides with a temperature determined by ring-and-ball method or micro melting point method with an error of within ±10° C. The "low softening point" herein indicates a softening point in the range of 230°–320° C. The softening point is closely connected with the melt spinning temperature of the pitch. The definition of spinning temperature herein is the maximum temperature of the pitch in a spinning machine required for suitable spinning operation and, not necessarily the temperature at the spinneret. In the usual spinning method, a fluidity suitable for the spinning is obtained at a temperature 60°–100° C. higher than the softening point in general, though it varies depending on the pitch used. Therefore, if the softening point is higher than 320° C., the spinning temperature is higher than 380° C. at which the thermal cracking and polycondensation occur and, therefore, the spinnability is reduced by the formation of cracked gas and an infusible matter. In addition, the pitch fibers thus obtained contain bubbles and solid extraneous matters which invites troubles. On the other hand, if softening point is lower than 230° C., the infusibilization treatment at a low temperature for a long period of time or complicated, expensive treatment is required unfavorably before carbonization.

Components O, A, B and C constituting the pitch of the present invention are defined as follows: A powdery pitch is placed in a cylindrical filter having an average pore diameter of 1μ and subjected to the thermal extraction with n-heptane by means of a Soxhlet's extractor for 20 hours. An n-heptane soluble matter thus obtained is called component O. Then, the residue is subjected to the thermal extraction with benzene for 20 hours to obtain an n-heptane-insoluble and benzene-soluble component (component A). The benzene-insoluble matter is subjected to the centrifugal separation (JIS K-2425) with quinoline as solvent to separate out a benzene-insoluble, quinoline-soluble β-resin (component B). The quinoline-insoluble component is called "component C". Those components can be fractionated by, for example, a method disclosed in "Sekiyu Gakkaishi (Journal of Petroleum Society), Vo. 20, (1), p. 45 (1977). Comparing pitch-constituting components O, A, B and C obtained from usual starting material, their C/H atomic ratio, fa value, number average molecular weight and the minimum and maximum molecular weights can be ranked generally as follows: Component O<component A<component B<component C.

According to the inventors' study, component O has the slightest property of forming molecular planar structure of the components constituting the pitch, i.e. the smallest condensed aromatic ring and, in addition, it has a large number of side chains with a larger length. However, component O has a relatively low giganticity (average molecular weight and maximum molecular weight). Component O itself does, therefore, not form the laminate structure easily and does not exhibit the optical anisotropic properties. It is compatible with other heavy components (components A, B and C) and supposed to act like a solvent. Thus, component O exerts an influence on fluidity and fusibility of the pitch.

Component A has a planar structure-forming property and giganticity of the molecule which are ranked between those of components O and B. If component A is used alone, it does not form the laminate structure easily and it is not optically anisotropic. However, it is compatible with component O and other heavy components and supposed to act as a solvent for the heavy components. Component A capable of forming an orientation together with the heavier components without reduction in its high orientation property exerts an influence mainly on the plasticity and fusibility of the pitch.

Component B has a planar structure-forming property and giganticity of the molecule which are ranged between those of components A and C. If component B is used alone, it exhibits a poor property of forming laminate structure or optically anisotropic property because it has a low fluidity and a softening point of higher than 400° C. Therefore, if component B is heated alone to a high temperature, it is not molten but carbonized. However, it is compatible with components O and A to have a fusibility and to act as a solvent for component C. Thus, component B in combination with component C exerts mainly an influence on the high orientation of the pitch.

Component C has the highest property of forming molecular planar structure and the highest molecular weight of the all components constituting the pitch. It easily forms a condensed polycyclic aromatic laminate structure which forms a skelton of the optically anisotropic pitch and it easily develops the optical anisotropy. However, component C itself has a softening point of higher than 400° C. like component B and, therefore, if it is used alone, it is not molten even by heating at a high temperature but is carbonized. However, it is compatible with components O, A and B to have a fusibility and plasticity and it participates in the high orientation of the pitch.

Thus, the optically anisotropic pitch comprises components compatible with other components to participate mainly in the orientation of the pitch and components which act as a solvent for other components to exert an influence mainly on the fusibility of the pitch without damaging the orientation. Both components are important. Particularly in the optically anisotropic pitch having a high orientation and homogeneity and a low softening point to be used for the production of high-performance carbon fibers, the structural characteristics of the components constituting the pitch and the well-balanced contents of those components are important. If components B and C are contained in excessive contents and components A and O are contained in relatively small contents, the pitch has a high softening point and it cannot be spun easily and, in an extreme case, the pitch is not molten at all, though a high molecular orientation is developed and the pitch is optically anisotropic as a whole. On the other hand, if components O and A are contained in excessive contents and components C and B are contained in relatively small contents, the pitch becomes heterogeneous and it comprises two bulk phases of (1) an optically anisotropic pitch phase having an excellent molecular orientation and (2) an isotropic pitch phase having a poor molecular orientation and, therefore, the spinning thereof becomes difficult as described above, though it has a low softening point and a liquid fluidity sufficient for the spinning can easily be attained at around 350° C.

As described above in detail, the component B and, particularly components O and A which have hardly been recognized in the prior art are important as constituents of a pitch used for the production of high-performance carbon fibers, in addition to component C which has been recognized in prior art as the principal constituent of optically anisotropic pitch. One of great characteristic features of the present invention is the limitation of the ranges of contents of these components in the pitch composition.

As a matter of course, even if the proportion of the components constituting the pitch is apparently fixed, properties of the pitch vary depending on the structural characteristics of the respective components. Namely, if components B and C having excessive molecular weights of inferior molecular planar structures are contained, the pitch has a quite high softening point. On the other hand, a pitch containing component O having an insufficient molecular weight cannot have a high homogeneity as a whole, though it has a low softening point.

Now, description will be made on the relationships between the molecular orientation, homogeneity, compatibility or softening point of the pitch for the production of high-performance carbon fibers and the characteristics of the components of the pitch. For the determination of the structural characteristics, the above described average molecular weight, molecular weight distribution, fa value and C/H atomic ratio of the respective components fractionated serve as the most suitable indications, since it is impossible to accurately detect or estimate the structures of the respective molecules constituting complicated mixtures such as pitch.

A degree of the development of the molecular orientation of pitch, i.e. optical anisotropy thereof, is connected with planar structure-forming properties and liquid fluidity at a given temperature of the pitch-constituting components. More particularly, when the condensed polycyclic aromatic structure (planar structural portion of the pitch molecule) is well developed and the molecular weight thereof is suitable, the planar molecules are easily associated together to form a laminate and, simultaneously, the re-arrangement of the molecules in molten state are effected sufficiently to form an optically anisotropic pitch.

The planar structure-forming properties of molecules can be represented substantially by C/H atomic ratio, aromatic structure ratio fa (ratio of carbon atoms belonging to aromatic structure to the total carbon atoms), since the planar structure-forming properties of the pitch-constituting molecules are determined by size of the condensed polycyclic aromatic ring, number of naphthene rings contained therein and number and length of side chains. More particularly, as the condensed polycyclic aromatic structure becomes larger, as number of naphthene ring structure therein is reduced or as number and length of the side chains are reduced, the planar structure in the pitch molecules is well-developed and generally C/H atomic ratio and fa value are increased generally. Only from a viewpoint of increasing the molecular planar structure, the larger molecular weight is the better. Since the liquid fluidity of the pitch at a given temperature may be considered to be determined by degree of freedom of the molecular motion, the liquid fluidity can be judged by taking as an indication the giganticity of the pitch molecules, i.e. number average molecular weight of the pitch molecules and molecular weight distribution (particularly, maximum molecular weight) thereof and the degree of the planar structure of the molecules. Namely, necessary conditions for attaining a high liquid fluidity of the high anisotropic pitch comprise a low number average molecular weight, a sufficiently low maximum molecular weight and an adequate planar structure of the molecule and, accordingly, adequate C/H atomic ratio and fa.

The homogeneity of the optically anisotropic pitch may be considered to be compatibilities of the components constituting the pitch with one another. This is considered to be connected with liquid fluidity at a given temperature. More particularly, when the molecules of the pitch-constituting components have chemical structures and molecular weight distributions which are not so different from one another, they have a mutual affinity and solubility. If they have sufficient liquid fluidities at a given temperature, they are dissolved in one another by the molecular motion to form a homogeneous stable pitch thermodynamically. Thus, it is considered that the homogeneity of the optically anisotropic pitch can be realized when the constituting components each have a sufficiently high C/H atomic ratio and fa value and a sufficiently low number average molecular weight and maximum molecular weight but are free from a component having an extremely low molecular weight and the components are not so different from one another and gradually change from O to C in the respective factors.

The softening point of the optically anisotropic pitch indicates a temperature at which the solid pitch is changed into liquid. The softening point, therefore, is connected with the liquid fluidity of the pitch at a given temperature as described above. Accordingly, the softening point of the optically anisotropic pitch is lowered when each of the components has a suitably high C/H atomic ratio and fa value and a sufficiently low average molecular weight, particularly, low maximum molecular weight.

Thus, it will be understood that for obtaining a homogeneous, optically anisotropic pitch having an excellent molecular orientation and a low softening point, each of the components should have (1) sufficiently high C/H atomic ratio and fa value each of which is very close to one another and (2) an average molecular weight which is sufficiently high for developing the planar molecular orientation but which is not excessively high in order to obtain a low softening point and, particularly, not so high maximum molecular weight and each of the components should be free of a compound having an extremely low molecular weight. When petroleum commercially available in a large amount at low costs or heavy oil and tars produced in coal industry are used as the starting material, it is impossible to perfectly control the chemical structure and molecular weight distribution in narrow ranges, since those starting materials have various molecular structures and broad molecular weight distributions. However, according to the present invention, an optically anistropic pitch having fully satisfactory molecular orientation, homogeneity and softening point can be obtained by controlling the chemical structural characteristics and molecular weights of the pitch-constituting components in preferred ranges and proportion of those components in a preferred, well-balanced range even if the chemical structure and molecular weight are not controlled perfectly.

Now, detailed, concrete description will be made on the chemical structural characteristics, preferred range of the molecular weight and preferred range of the proportion of the pitch-constituting components of B and C especially.

Component O is an oily substance having a not so high molecular weight and an aromatic structure not sufficiently developed unlike other components, i.e. generally C/H atomic ratio of up to 1.6, fa value of up to 0.95 and a number average molecular weight of up to 1,000. The preferred ranges of component O has been described satisfactorily above.

Component A has structural characteristics and a molecular weight generally ranked between those of components O and B. Supposedly, component A contributes to the molecular orientation a little more actively than component O. It is compatible with component O to act as solvent or plasticizer on components B and C. Component A is also an indispensable constituent of the heterogeneous, optically anisotropic pitch having a low softening point. The preferred ranges of this component has been described enough.

Component B has structural characteristics and a molecular weight generally ranked between those of components A and C. As compared with components O and A, it has an well developed condensed polycyclic aromatic planar structure. The planes are easily associated to form a laminate, thereby forming the molecular orientation. Component B is compatible with component C to cause the optical anisotropy, namely a skeleton having a molecular orientation. In addition, component B is also compatible with components O and A to act as a plasticizer. Supposedly, if component B is further polycondensed, it is converted to component C.

According to the present invention, component B has preferably a C/H atomic ratio of 1.5–1.9 and an fa value of 0.80–0.95, is 100% solubilized in chloroform by the hydrogenation reaction treatment which will be described below and has an estimated number average molecular weight of 800–2,000 and an estimated maximum molecular weight of no higher than 10,000. The preferred range of the content of component B which is changed mainly by the content of component C is 5–40 wt. % based on the whole pitch. If C/H atomic ratio or fa value is lower than the above described range or if the content of component B is smaller than the above range, the molecular orientation of the pitch is insufficient and the intended homogeneous, optically anisotropic pitch cannot be obtained in many cases. In this case, if the content of coexistent component C is too large, the resulting pitch has a high softening point, though it is optically anisotropic and homogeneous. Further, if estimated number average molecular weight or estimated maximum molecular weight is higher than the above described range or if the content of component B is larger than the above range, the resulting pitch has a too high softening point and the spinning thereof is difficult, though the pitch is homogeneous and optically anisotropic. This pitch is not the one intended in the present invention.

Component C has the most highly developed molecular planar structure of the all pitch-constituting components and it has the highest molecular weight. The planar molecules thereof are easily associated to form a laminate, thereby exhibiting the optical anisotropy. Component C is compatible with other components in the pitch to form a skeleton of the optically anisotropic structure.

According to the present invention, component C has preferably a C/H atomic ratio of at least 1.8 and an fa value of at least 0.85. Component C that can be substantially completely solubilized in chloroform by the hydrogenation reaction treatment which will be described below is preferable in this invention. It has an estimated number average molecular weight of 1,500–3,000 and an estimated maximum molecular weight of no higher than 30,000. The preferred content of component C which varies depending on the amount of component B is in the range of 25–65 wt. % on the whole pitch. If C/H atomic ratio or fa value of component C is lower than the above range or if the amount thereof is smaller than the above range, the molecular orientation of the whole pitch is insufficient and heterogeneous pitch containing a considerable amount of isotropic moiety is obtained or the pitch has a high softening point in some cases wherein the component is not well-balanced with the other components. Further, in some cases, component C is not perfectly solubilized in chloroform by the hydrogenation reaction which will be described below. Such component C is unsuitable, since it contains condensed polycyclic aromatic compound having such a high molecular weight that the molecular weight estimation thereof is impossible or infusible matters such as carbon. After the solubilization in chloroform by the hydrogenation reaction, if component C has an estimated number average molecular weight or maximum molecular weight higher than the above range or if the amount of component C is larger than the above range, the resulting pitch has a high softening point and, therefore, requires a high spinning temperature or the spinning thereof becomes impossible in many cases, though the whole pitch becomes optically anisotropic.

fa value (ratio of carbon in the aromatic structure; ratio of number of carbon atoms in the aromatic structure to number of the total carbon atoms) herein is calculated from a ratio of hydrogen content to carbon content of the pitch-constituting sample analyzed and infrared absorption spectroanalysis according to the following formula by a method of Kato et al. ["Nenryo Kyokai-shi" (Journal of The Fuel Society of Japan) 55, 244, (1976)]

$$Fa = 1 - \frac{H/C}{2 \cdot \left(1 + 2 \cdot \frac{D_{3030}}{D_{2920}}\right)}$$

wherein:

H/C=atom number ratio of hydrogen to carbon $D_{3030}/D_{2920}$=ratio of absorbancy at 3030 $cm^{-1}$ to absorbancy at 2920 $cm^{-1}$.

The number average molecular weight according to the present invention is determined by general vapor pressure equilibrium method using chloroform as solvent. The molecular weight distribution is determined by dividing a pitch sample into 10 molecular weight fractions by gel permeation chromatography using chloroform as solvent, measuring number average molecular weights of the respective fractions by the above vapor pressure equilibrium method, preparing calibration curves of the gel permeation chromatography from a relationship between eluted volume and number average molecular weight in each fraction and determining the molecular weight distribution in each component of the pitch. In this case, a change in refractive index of the eluate is substantially proportional to a change in the concentration (weight).

The molecular weights of components B and C cannot be determined directly, since they contain a chloroform-insoluble matter. It has been known that if they are subjected to the mild hydrogenation reaction to add hydrogen atoms to a part of the aromatic structures without destroying the carbon-to-carbon bond, their molecular structures are converted to those soluble in chloroform without substantially changing the carbon skeletons of the molecules.

According to the present invention, components B and C are previously solubilized in chloroform by the mild hydrogenation reaction with metallic lithium and ethylenediamine [according to a method disclosed in "Fuel" 41, 67–69 (1962)] and then their number average molecular weights, maximum molecular weights and minimum molecular weights are determined by the above molecular weight measuring method.

The carbonaceous pitch used in the present invention may be prepared by any method. However, the following process is particularly preferred: A heavy hydrocarbon oil, tar or pitch used as starting material is subjected to the thermal cracking/polycondensation reaction to form partial, optically anisotropic phase, then the optically anisotropic phase is precipitated out at a temperature at which the molecular weight is no more increased to obtain a pitch comprising the condensed optically anisotropic phase and this is further subjected to the thermal treatment for a short period of time to obtain a pitch containing at least 90% of optically anisotropic phase.

More concretely, the preferred process comprises as follows: Heavy hydrocarbon oil, tar or pitch used as the starting material is subjected to the thermal cracking-/polycondensation reaction at a temperature of at least 380° C., preferably 400°–440° C. to form 20–80%, preferably 30–60%, of an optically anisotropic phase in the polycondensate. The polycondensate is allowed to stand at a temperature kept below about 400° C., preferably at 360°–380° C. for a time ranging from 5 minutes to about one hour or, alternatively, the polycondensate is stirred very slowly to precipitate the optically anisotropic phase of the pitch of a higher density in the lower layer in a high concentration. Then, the lower layer having a higher concentration of the optically anisotropic phase is separated out from the upper layer having a lower concentration of the optically anisotropic phase. Thus obtained pitch (lower layer having an optically anisotropic phase content of 70–90%) is further subjected to the heat treatment at a temperature of above about 380° C., preferably at 390°–440° C. for a short time to obtain the intended pitch having an optically anisotropic phase content of at least 90%.

The optically anisotropic pitch of the present invention is characterized in that the respective pitch-constituting components as described above have specific characteristics and are contained in the pitch in specific ranges of contents. Therefore, plural kinds of pitches having almost desired compositions (constituents) and characteristics produced even by another process or under conditions not covered by the present invention can be mixed together in a desired proportion to form the optically anisotropic pitch having satisfactory pitch composition and characteristics and the desired physical properties within the ambit of the present invention, even if the above, respective pitch-constituting components produced by a series of steps are not covered by the range of the present invention.

For example, the optically anisotropic carbonaceous pitch of the present invention can be obtained also by subjecting a starting heavy hydrocarbon oil, tar or pitch to the thermal cracking/polycondensation at a temperature of higher than 380° C., preferably 410°–440° C. for a comparatively long period of time to obtain an optically anisotropic pitch having high contents of components C and B, low contents of components O and A and a high softening point, separately subjecting the same starting material to the thermal cracking/polycondensation at the same temperature as above but for a relatively short time to obtain isotropic pitch having low contents of components C and B and high contents of components O and A and, thereafter, mixing both pitches in a suitable ratio. Further, if the starting material is selected rigidly, the optically anisotropic carbonaceous pitch of the present invention can be obtained by only the above, first thermal cracking/polycondensation reaction step carried out at a temperature of above 380° C., preferably 410°–440° C. The optically anisotropic pitch of the present invention can be produced by still another process which comprises subjecting a pitch obtained by the thermal cracking/polycondensation of heavy hydrocarbon oil, tar or pitch or commercially available pitch to the extraction with solvents, such as n-heptane, toluene or benzene to divide the same into a soluble fraction and an insoluble fraction, separately and previously producing a pitch material comprising concentrated components O, A, B and C in known contents and mixing them in a desired mixing ratio.

The pitch fibers obtained by the melt spinning of the optically anisotropic pitch of the present invention and the spinning methods will be described below. The spinning may be effected by conventional methods. For example, the pitch is charged in a metal spinning vessel having a spinning nozzle of 0.1–0.5 mm diameter at the bottom thereof, then an inert gas pressure in the vessel is elevated to several hundred mm Hg while the pitch is kept in molten state at a given temperature in the range of 280°-370° C. in an inert gas atmosphere to extrude the molten pitch through the nozzle and to allow the extruded pitch to flow downwards, and the flowing pitch fibers are rolled round a bobbin rotating at a high speed while temperature and atmosphere in the flowing region are controlled or the filaments are bundled and collected in a collecting bucket positioned below the spinning vessel by drawing the same by means of air stream. In this step, the continuous spinning is made possible by feeding a previously molten pitch in the spinning vessel by means of a gear pump or the like to give pressure. In a variation of the above method, the pitch fibers are taken off while the filaments are drawn near the nozzle by means of a gas flow descending at a high speed at a given, controlled temperature to from short fibers, long fibers or non-woven fabric in the from of a mat comprising fibers confounded, on a belt conveyer positioned below. In another method, the molten pitch is continuously fed into a cylindrical spinning vessel having spinning nozzles on the cylindrical wall thereof and rotating at a high speed to extrude the pitch through the nozzle by centrifugal force and to draw the extruded pitch filaments by the rotating force and the filaments are collected. If the pitch of the present invention is used in any of the above methods, a characteristic feature can be exhibited that the temperature (the highest temperature of pitch in the spinner) suitable for the spinning of the molten pitch is in the range of 280°-370° C. which is lower than that employed in the conventional methods. Accordingly, the thermal cracking and thermal polymerization occur only slightly in the spinning step. As a result, another characteristic feature is obtaned that the pitch fibers thus spun have substantially the same composition as that of the pitch not spun yet.

If a section in the direction of fiber aixs of thus obtained carbonaceous pitch fiber is polished and observed by means of a polarized light microscope, the whole surface of the section is optically anisotropic and the orientation is recognized in the direction of fiber axis. A section perpendicular to the fiber axis is almost isotropic or it is recognized therein that very fine anisotropic parts are gathered together at random to form a very fine mosaic. This phenomenon occurs probably for the following reasons: The pitch O and A having high fluidities. Therefore, a high molecular orientation in a direction of fiber axis is attained in the spinning step. On the other hand, the molecular orientation in a direction perpendicular to the fiber axis is relatively free and flexible. If the pitch fibers are ground into powder, fractionated into components O, A, B and C with an organic solvent and analyzed, the analytical results are substantially equal to those of the non-spun pitch composition with respect to the composition and characteristics, which is covered by the ambit of the present invention.

An optically anisotropic pitch used in the prior art is spun while it is maintained in the molten state at a temperature of as high as 380°-430° C. at least in a some part of spinner. In such a case, the thermal cracking and thermal polymerization occur remarkably. As a result, the composition and structure of the pitch fibers thus spun are different from those observed prior to the spinning and have a higher degree of carbonization in many cases.

The present invention has an advantage that the pitch fibers of the present invention have a composition substantially the same as that of the non-spun pitch and, therefore, even when pitch fibers of a quality lower than an allowable limit in the quality control are obtained, they can be molten for the use again. The pitch fibers thus obtained from the substantially homogeneous optically anisotropic pitch of the low softening point formed by the present invention are made completely infusible by heating to a temperature above 200° C. for a time ranging from about 10 minutes to about one hour under oxidative atmosphere. The pitch fibers thus made infusible are carbonized by heating the same to 1,500° C. in inert gas. Thus resulting carbon fibers have tensile strength of 2.1-4.1 GPa, and tensile modules of elasticity of $2.2-3.5\times10^2$ GPa, though the properties vary depending on diameters thereof.

It will be apparent from the above descriptions that for precisely defining the optically anisotropic pitch, the characteristics of the pitch-constituting components and contents thereof are important and that the homogeneous pitch having a high orientation and a low softening point used for the production of high performance carbon fibers should have characteristics and contents of the pitch-constituting component (particularly components O and A) within above ranges.

The optically anisotropic pitch comprising components having the above characteristics in the above ratio has an extremely low softening point of below 320° C. and, therefore, it can be spun at a sufficiently low melt spinning temperature (below 380° C.; and 300°-360° C. in general embodiments), even though it is the substantially homogeneous pitch having 90-100% optically anisotropic phase content. Consequently, the following merits can be obtained:

(1) The pitch can be spun at a temperature sufficiently lower than a temperature at which the thermal cracking and polycondensation occur remarkably. The homogeneous pitch has an excellent spinnability (freeness from fiber breaking, high thinness and homogeneous fiber diameter). Using the pitch of the present invention, productivity in the spinning step is improved. Further, the resulting carbon fibers have a stable quality, since the pitch quality is unchanged during the spinning.

(2) The formation of decomposed gas and infusible matter is very slight in the spinning operation. Therefore, the pitch fibers thus spun is substantially free from defects in pitch fibers (i.e. bubbles and solid coke-like substances) and thus resulting carbon fibers have a high strength.

(3) Carbon fibers spun from the carbonaceous pitch of the present invention have a well-developed orientation in graphite structure in the direction of the fiber axis and a high modulus of elasticity, since the starting carbonaceous pitch is nearly wholly in the form of a liquid crystal having an excellent molecular orientation.

(4) In thus obtained carbon fibers, the structure of the section in the direction perpendicular to the fiber axis is fine, the orientation of the fibril in the direction perpendicular to axis is low and is little like concentric circle or little radial. Accordingly, cracks are hardly formed in a direction of fiber axis. The effects of the present invention are thus beyond the expectation.

EXAMPLE 1

A tar which was obtained by the reduced pressure distillation of a tarry substance by-produced by the catalystic cracking of petroleum oil to a temperature of 450° C. (calculated under atmospheric pressure) was used as the starting material. The starting material had a carbon content of 90.0 wt. %, hydrogen content of 7.8 wt. %, specific gravity of 1.07 and quinoline-insoluble component content of 0%. 1000 g of the starting material was charged in a 1.45 liter stainless steel reaction device and subjected to the thermal cracking/polycondensation reaction under nitrogen gas stream and under enough stirring at 415° C. for 2.5 hours to obtain a pitch which had a softening point of 187° C., specific gravity of 1.32 and quinoline-insoluble component of 7.9 wt. % and which contained about 40% of spherical, optically anisotropic spheres having a diameter of up to 100 μm in the optically isotropic mother phase (observed by means of as polarized light microscope). Yield: 17.0 wt. % based on the starting material. Then, 100.0 g of the pitch was taken in about 300 ml cylindrical glass vessel and kept at 360° C. under nitrogen atmosphere for 30 minutes without stirring. The pitch was then allowed to cool and the glass vessel was broken to take out the pitch. It was recognized with the naked eye from a difference in gloss that the pitch comprised upper and lower layers clearly separated from each other. The pitch mass in the upper layer could be peeled off from the pitch mass in the lower layer. Yield of the pitch in the lower layer was about 32 g. The pitches were examined by means of a polarized light microscope to reveal that the pitch in the upper layer was mostly an optically isotropic pitch containing about 15% of optically anisotropic spheres having a diameter of up to 50 μm and the pitch in the lower layer was mostly an optically anisotropic pitch containing about 20% of optically isotropic spheres having a diameter of about 50 μm. Namely, it was a pitch having an optically anisotropic phase content of about 80%. Then, the pitch in the lower layer was charged in a 50 ml glass vessel and heat-treated under stirring at 400° C. for 30 minutes to obtain about 30 g of a pitch. A softening point of the pitch measured was 257° C. and its optically anisotropic phase content was higher than about 95%. An n-heptane-soluble component (component O) and n-heptane-insoluble and benzene-soluble component (component A) of the pitch were determined to reveal that contents of components O and A were 10.1 wt. % and 29.6 wt. %, respectively. The balance of the pitch comprised benzene-insoluble components.

Then, the pitch was charged in a spinning vessel having a nozzle of a diameter of 0.5 mm, molten at 340° C., extruded under a nitrogen pressure of 100 mmHg and rolled round a bobbin rotating at a high speed. The fibers were thus taken down and spun at a speed of 500 m/min. The breaking of the fibers was hardly observed. Pitch fibers having a diameter of 8–12 μm were obtained. A part of the pitch fibers was maintained in an oxygen atmosphere at 230° C. for one hour, then heated to 1500° C. in nitrogen gas at a temperature elevation rate of 30° C./min. and immediately allowed to cool to obtain carbon fibers. The carbon fibers had a tensile strength of about 3 GPa and a modulus in tension of about $2.2\times10^2$ GPa.

An aliquot of 1 g was taken from the residual part of the pitch fibers and n-heptane-soluble component (component O) and n-heptane-insoluble and benzene-soluble component (component A) were determined to reveal that they were 8.9 wt. % and 29.8 wt. %, respectively.

COMPARATIVE EXAMPLE 1

1,000 g of the same tar as in Example 1 was used as the starting material and charged in a 1.45 liter stainless steel reaction device and subjected to the thermal cracking and polycondensation reactions under enough stirring under nitrogen gas stream at a temperature maintained at 415° C. for 5 hours to obtain 110 g of residual pitch which had a softening point of 312° C., a specific gravity of 1.36 and a quinoline-insoluble matter content of about 60%. The resulting pitch was observed by means of a polarized light microscope to reveal that it was nearly wholly optically anisotropic pitch in which optically isotropic globules having a diameter of less than about 50 μm were dispersed, i.e. a pitch having an optically anisotropic phase content of at least about 95%.

The pitch was spun in the same spinning vessel as in Example 1. The spinning was quite difficult at a temperature of below 380° C. The spinning was possible to some extent at a temperature of 390°–410° C. but white fumes are apt to be generated around the spinning nozzle and fiber breaking frequency was as high as at least once per minute even at a taking off speed of 300 m/sec. The resulting fibers had a diameter of 15–18 μm. A part of thus obtained pitch fibers was infusibilized and carbonized in the same manner as in Example 1 to obtain carbon fibers. The carbon fibers had a tensile strength of about 1.2 GPa and a modulus in tension of about $2\times10^2$ GPa. n-Heptane-soluble component (component O) and n-heptane-insoluble and benzene-soluble component (component A) contained in the pitch were determined to reveal that they were 1.3 wt. % and 14.2 wt. %, respectively.

EXAMPLE 2

A tar which was obtained by the reduced pressure distillation of a tarry substance by-produced by the catalytic cracking of petroleum oil to a temperature of 450° C. (calculated under atmospheric pressure) was used as the starting material. The starting material had a carbon content of 89.4%, hydrogen content of 8.9 wt. %, specific gravity of 1.06 and quinoline-insoluble component content of 0%. 1,000 g of the starting material was charged in a 1.45 liter stainless steel reaction device and subjected to the thermal cracking/polycondensation reaction under nitrogen gas stream and under enough stirring at 440° C. for one hour to obtain a pitch which had a softening point of 220° C., specific gravity of 1.33 and quinoline-insoluble component (component C) of 14 wt. % and which obtained about 60% of completely spherical, optically anisotropic spheres having a diameter of up to 200 μm in the optically isotropic mother phase (observed by means of a polarized light microscope). Yield: 22 wt. % based on the starting material. Then, the pitch was taken in a cylindrical vessel having an inner diameter of 4 cm and a length of 70 cm which was provided with a take off valve at the bottom. The pitch was kept at 380° C. under nitrogen atmosphere under stirring at 15 rpm for 30 minutes. The valve at the bottom of the vessel was opened under an elevated nitrogen pressure of 100 mmHg to allow the relatively viscous pitch in the lower layer to flow down gently. The pitch was collected in a vessel in which nitrogen gas was passed. The pitch thus taken out until the viscosity of thus flowing pitch was remarkably reduced will be called "pitch in the lower layer". Yield thereof was about 38 wt. % based on the charge stock. Thereafter, the pitch in the upper layer remaining in the vessel was allowed to flow out and collected separately from the former pitch. This will be called "pitch in the upper layer" and yield thereof was about 61 wt. % based on the charge stock. The pitch in the upper layer comprised substantially optically isotropic phase containing about 20% of spherical, optically anisotropic spheres having a diameter of up to 20μ and which had a softening point of 195° C., specific gravity of 1.31, component C content of about 4 wt.%, component B content of about 38 wt. %, component A content of about 36 wt. % and component O content of about 22 wt. %. On the other hand, the pitch in the lower layer comprised an optically anisotropic phase having large flow marks and having an isotropic phase content of 15–20%. The pitch had a softening point of 252° C., specific gravity of 1.35, component C content of about 21 wt. %, component B content of about 37 wt. %, component A content of about 33 wt. % and component O content of about 9 wt. %. Then, the pitch in the lower layer was heat treated at 390° C. under nitrogen atmosphere under thorough stirring for about 30 minutes in a 250 ml reaction vessel to obtain a pitch, which will be referred to as Sample 2. A pitch heat-treated under the same conditions as above for about 50 minutes will be referred to as Sample 1. By the observation by means of a polarized light microscope, it was revealed that Sample 1 comprised substantially optically anisotropic phase having a softening point of about 260° C. and that Sample 2 comprised substantially optically isotropic phase containing about 5% of the optically isotropic phase in the form of fine spheres dispersed therein and having a softening point of 257° C. Then, Samples 1 and 2 were divided into components O, A, B and C by the separation analysis with solvents. Their proportions as well as C/H atomic ratio, fa, number avergage molecular weight, minimum molecular weight and maximum molecular weight of each component were measured. The results are shown in Table 1.

Each of pitch samples 1 and 2 was filled in a spinning vessel having a nozzle having a diameter of 0.5 mm, molten at a temperature of around 350° C. and extruded under a nitrogen pressure of below 200 mmHg. The fibers were rolled round a bobbin rotating at a high speed. In both cases, pitch fibers having a diameter of 5–10 μm could be obtained at a speed of as high as 500 m/min. with only a small number of filament breakage. The results are shown in Table 2. The pitch fibers obtained from Samples 1 and 2 were evaluated by a method shown in Example 5.

COMPARATIVE EXAMPLE 2

The same tar as in Example 2 was used as the starting material. 1,000 g of the starting material was charged in a 1.45 liter heat treatment device and subjected to the thermal treatment at 430° C. under enough stirring under nitrogen gas stream for 1.5 hours to obtain a pitch having a softening point of 217° C., specific gravity of 1.33 and quinoline-insoluble component (component C) content of 13 wt. %. The resulting pitch was observed by means of a polarized light microscope to reveal that it comprised about 60% of completely spherical, optically anisotropic fine globules having a diameter of less than 200μ dispersed in an optically isotropic mother phase. Yield: 19.6 wt. % based on the starting material. This pitch will be referred to as Sample 3.

Sample 3 was divided into the respective components by the separation analysis with solvents in the same manner as in Example 2. Contents and characteristics of the respective components were measured. The results are shown in Table 1. This sample was spun in the same manner as in Example 2. It could not be spun at a speed of 500 m/min. Even at a speed of 300 m/min., the breaking frequency was high and fine pitch fibers could not be obtained. The results are shown in Table 2.

TABLE 1

| | Characteristics of optically anisotropic pitches and components thereof | | | | | | | | |
|---|---|---|---|---|---|---|---|---|---|
| | Properties of the whole pitch | | Properties of constituents of the pitch | | | | | | |
| Pitch sample | Softening point (°C.) | Optically anisotropic phase content (%) | Constituents | Content (wt. %) | C/H atomic ratio | fa | Number average molecular weight (VPO) | Minimum molecular weight (GPC) | Maximum molecular weight (GPC) |
| Sample 1 (present invention) | 260 | 100 | Component O | 6 | 1.38 | 0.84 | 415 | 175 | — |
| | | | Component A | 24 | 1.47 | 0.86 | 515 | — | 2,040 |
| | | | Component B | 27 | 1.71 | 0.87 | 1130 | — | 7,200 |
| | | | Component C | 43 | 1.90 | 0.92 | 1850 | — | 19,000 |
| Sample 2 (present invention) | 257 | 95 | Component O | 9 | 1.37 | 0.83 | 412 | 165 | — |
| | | | Component A | 25 | 1.47 | 0.86 | 505 | — | 1,970 |
| | | | Component B | 24 | 1.71 | 0.87 | 1130 | — | 7,200 |
| | | | Component C | 42 | 1.90 | 0.91 | 1880 | — | 18,500 |
| Sample 3 (comparative) | 217 | 60 | Component O | 7 | 1.35 | 0.83 | 388 | 165 | — |
| | | | Component A | 44 | 1.46 | 0.86 | 470 | — | 1,730 |
| | | | Component B | 36 | 1.70 | 0.87 | 1060 | — | 6,800 |
| | | | Component C | 13 | 1.89 | 0.90 | 1810 | — | 15,500 |

TABLE 2

| | Spinning properties of optically anisotropic pitches | | | | | | | | |
|---|---|---|---|---|---|---|---|---|---|
| | Properties of pitch before spinning | | Spinning conditions | | | Breaking frequency (time/10 mins.) | Diameter of the (average value) (μ) | Properties of pitch after spinning | |
| Pitch sample | Softening point (°C.) | Component C (wt. %) | Temp. (°C.) | Speed (m/min.) | Spinning time (min.) | | | Softening point (°C.) | Component C (wt. %) |
| Sample 1 (present invention) | 260 | 43 | 350 | 500 | 10 | less than 1 | 7.6 | — | — |
| | | | | | 60 | " | 6.7 | — | — |
| | | | | | 180 | " | 8.6 | 263 | 44 |

TABLE 2-continued

| Pitch sample | Properties of pitch before spinning: Softening point (°C.) | Properties of pitch before spinning: Component C (wt. %) | Spinning properties of optically anisotropic pitches: Spinning conditions: Temp. (°C.) | Spinning conditions: Speed (m/min.) | Spinning conditions: Spinning time (min.) | Breaking frequency (time/10 mins.) | Diameter of the (average value) (μ) | Properties of pitch after spinning: Softening point (°C.) | Properties of pitch after spinning: Component C (wt. %) |
|---|---|---|---|---|---|---|---|---|---|
| Sample 2 (present invention) | 257 | 42 | 345 | 500 | 10 | less than 1 | 6.8 | — | — |
| | | | | | 60 | " | 8.8 | — | — |
| | | | | | 120 | " | 10.5 | 262 | 45 |
| Sample 3 (comparative) | 217 | 13 | 343 | 300 | 10 | more than 20 | 15.3 | — | — |
| | | | | | 60 | " | 17.1 | 227 | 17 |

EXAMPLE 3

Pitches having characteristics shown in Table 3 were obtained from the same starting tar as in Example 2 but under varied reaction conditions. Those pitches were spun by means of a spinning device having a nozzle having a diameter of 0.5 mm as in Example 2 under a nitrogen pressure of less than 200 mmHg. The results are summarized in Table 4.

Optically anisotropic pitches (Samples 4–6) according to the present invention had excellent spinning properties. Samples 4–6 were used in Example 5.

COMPARATIVE EXAMPLE 3

Pitches which were beyond the scope of the present invention were produced from the same starting tar as in Example 2 but under varied reaction conditions to obtain Comparative Samples 7 and 8. Characteristics of them are shown in Table 3 and spinning characteristics of them are shown in Table 4. Sample 7 was used in Example 5.

TABLE 3

| Pitch sample | Properties of the whole pitch: Softening point (°C.) | Properties of the whole pitch: Optically anisotropic phase content (%) | Characteristics of optically anisotropic pitches and components thereof: Properties of constituents of the pitch: Constituents | Content (wt. %) | C/H atomic ratio | fa | Number average molecular weight (VPO) | Minimum molecular weight (GPC) | Maximum molecular weight (GPC) |
|---|---|---|---|---|---|---|---|---|---|
| Sample 4 (present invention) | 252 | 95 | Component O | 11 | 1.35 | 0.82 | 383 | 170 | — |
| | | | Component A | 28 | 1.46 | 0.85 | 575 | — | 1,850 |
| | | | Component B | 32 | 1.63 | 0.88 | 1,160 | — | 6,900 |
| | | | Component C | 29 | 1.89 | 0.91 | 1,760 | — | 16,500 |
| Sample 5 (present invention) | 261 | 100 | Component O | 7 | 1.35 | 0.83 | 554 | 175 | — |
| | | | Component A | 33 | 1.47 | 0.87 | 705 | — | 2,050 |
| | | | Component B | 25 | 1.64 | 0.90 | 1,310 | — | 6,800 |
| | | | Component C | 35 | 1.90 | 0.92 | 2,250 | — | 19,500 |
| Sample 6 (present invention) | 279 | 100 | Component O | 9 | 1.34 | 0.84 | 545 | 180 | — |
| | | | Component A | 22 | 1.46 | 0.86 | 640 | — | 1,830 |
| | | | Component B | 7 | 1.61 | 0.87 | 1,175 | — | 7,600 |
| | | | Component C | 62 | 1.95 | 0.94 | 1,940 | — | 16,600 |
| Sample 7 (comparative) | 335 | 100 | Component O | 2 | 1.30 | 0.83 | 620 | 230 | — |
| | | | Component A | 12 | 1.49 | 0.85 | 790 | — | 2,120 |
| | | | Component B | 22 | 1.70 | 0.87 | 1,410 | — | 9,300 |
| | | | Component C | 64 | 1.93 | 0.95 | 2,190 | — | 27,000 |
| Sample 8 (comparative) | 248 | 80 | Component O | 17 | 1.28 | 0.82 | 515 | 155 | — |
| | | | Component A | 35 | 1.43 | 0.83 | 627 | — | 1,780 |
| | | | Component B | 21 | 1.60 | 0.86 | 1,160 | — | 7,200 |
| | | | Component C | 27 | 1.88 | 0.89 | 2,050 | — | 17,500 |

TABLE 4

| Pitch sample | Properties of pitch before spinning: Softening point (°C.) | Properties of pitch before spinning: Component C (wt. %) | Spinning properties of optically anisotropic pitches: Spinning conditions: Temp. (°C.) | Spinning conditions: Speed (m/min) | Spinning conditions: Spinning time (min) | Breaking frequency (time/10 mins.) | Diameter of the fiber (average value) (μ) | Properties of pitch after spinning: Softening point (°C.) | Properties of pitch after spinning: Component C (wt. %) |
|---|---|---|---|---|---|---|---|---|---|
| Sample 4 (present invention) | 252 | 29 | 335 | 500 | 10 | less than 1 | 8.4 | — | — |
| | | | | | 60 | " | 7.2 | — | — |
| | | | | | 180 | " | 9.3 | 252 | 29 |
| Sample 5 (present invention) | 261 | 35 | 350 | 500 | 10 | less than 1 | 8.4 | — | — |
| | | | | | 60 | " | 8.5 | — | — |
| | | | | | 180 | " | 9.9 | 264 | 37 |

TABLE 4-continued

| Pitch sample | Properties of pitch before spinning: Softening point (°C.) | Component C (wt. %) | Spinning properties of optically anisotropic pitches: Spinning conditions: Temp. (°C.) | Speed (m/min) | Spinning time (min) | Breaking frequency (time/10 mins.) | Diameter of the fiber (average value) (μ) | Properties of pitch after spinning: Softening point (°C.) | Component C (wt. %) |
|---|---|---|---|---|---|---|---|---|---|
| Sample 6 | 279 | 49 | 360 | 500 | 10 | less than 1 | 18.0 | — | — |
| | | | | | 60 | " | 7.8 | — | — |
| | | | | | 120 | " | 9.7 | 283 | 52 |
| Sample 7 (comparative) | 335 | 64 | 410 | 300 | 10 | 12 | 13.2 | — | — |
| | | | | | 60 | more than 20 | 15.5 | 350 | 68 |
| Sample 8 (comparative) | 248 | 27 | 340 | 300 | 10 | 4 | 11.7 | — | — |
| | | | | | 60 | 11 | 14.0 | 253 | 29 |

COMPARATIVE EXAMPLE 4

A residual tar obtained by the reduced pressure distillation of a tarry substance by-produced by the thermal cracking of naphtha to a temperature of 450° C. (calculated under atmospheric pressure) was used as the starting material. The starting material had a carbon content of 93.5 wt. %, hydrogen content of 7.5 wt. %, specific gravity of 1.15 and quinoline-insoluble component (component C) content of 0%. 1,000 g of the starting oil was heat-treated at 415° C. in the same heat treatment device as in Example 2 under enough stirring under nitrogen gas stream under atmospheric pressure for 4.0 hours. Thus obtained pitch comprised an optically isotropic mother phase containing about 10 wt. % of fine spheres of optically anisotropic phase having a diameter of less than 20μ (by the observation by means of a polarized light microscope). The pitch had a softening point of 340° C., carbon content of 94.2 wt. % and hydrogen content of 5.4 wt. %. Yield: 31.3 wt. % based on the starting material. This pitch will be referred to as Sample 9.

Sample 9 was spun by means of a spinning device having a nozzle having a diameter of 0.5 mm as in Example 1 under a nitrogen pressure of below 200 mmHg. It could not be spun at a speed of 500 m/min. Evan at a speed of 300 m/min., the breaking frequency was high and fine pitch fibers could not be obtained. A change probably due to the thermal cracking and polycondensation of the pitch during the spinning was remarkable.

COMPARATIVE EXAMPLE 5

The same starting tar as in Comparative Example 4 was added in an amount of 30 wt. % to the same starting tar as in Example 2 to obtain a mixed starting material having a carbon content of 90.8 wt. %, hydrogen content of 8.5 wt. %, specific gravity of 1.10 and quinoline-insoluble component content of 0%. 1,000 g of the mixed material was heat-treated at 415° C. for 3.5 hours in the same manner as in Example 2 to obtain a pitch having a softening point of 236° C., specific gravity of 1.31 and quinoline-insoluble component content of 12 wt. %. It was revealed by the observation by means of a polarized light microscope that the pitch comprised an optically isotropic mother phase in which spheres of optically anisotropic phase having a diameter of less than 100μ and irregular elliptic, coalesced particles having a diameter of around 100μ were dispersed. Those optically anisotropic phases were contained in an amount of about 40% based on the whole pitch. Yield: 18.8 wt. % based on the starting material. The pitch was kept at 380° C. for two hours in the same manner as in Example 2. A cock at the bottom of the reaction vessel was opened to take out 27.7 wt. %, based on the charge stock, of a viscous pitch. The pitch in the lower layer comprised about 95% of an optically anisotropic phase having small and large flow marks which contained about 5% of an optically isotropic phase in the form of irregular elliptic particles having a diameter of less than 300μ. The pitch had a softening point of 329° C., specific gravity of 1.34, carbon content of 94.2 wt. % and hydrogen content of 4.8 wt. %. The pitch in the lower will be referred to as Sample 10.

Sample 10 was fractionated into components O, A, B and C and spun in the same maner as in above Comparative Example 4. Characteristics of the respective components are shown in Table 5 and spinning properties thereof are shown in Table 6. Like Sample 9, Sample 10 could not be spun at a speed of 500 m/min. Even at a speed of 300 m/min., breaking frequency was high and thin pitch fibers could not be obtained.

TABLE 5

| Pitch sample | Characteristics of pitches and components thereof: Properties of the whole pitch: Softening point (°C.) | Optically anisotropic phase content (%) | Properties of constituents of the pitch: Constituents | Content (wt. %) | C/H atomic ratio | fa | Number average molecular weight (VPO) | Minimum molecular weight (GPC) | Maximum molecular weight (GPC) |
|---|---|---|---|---|---|---|---|---|---|
| Sample 9 (comparative) | 340 | 10 | Component O | 3 | 1.13 | 0.73 | 572 | 191 | — |
| | | | Component A | 32 | 1.30 | 0.80 | 890 | — | 9,500 |
| | | | Component B | 53 | 1.58 | 0.85 | 2,340 | — | 24,000 |
| | | | Component C | 12 | 1.64 | 0.85 | 3,950 | — | 59,000 |
| Sample 10 (compara- | 329 | 95 | Component O | 5 | 1.33 | 0.80 | 465 | 207 | — |
| | | | Component A | 28 | 1.45 | 0.85 | 628 | — | 7,400 |

TABLE 5-continued

| Pitch sample | Properties of the whole pitch: Softening point (°C.) | Properties of the whole pitch: Optically anisotropic phase content (%) | Characteristics of pitches and components thereof — Properties of constituents of the pitch: Constituents | Content (wt. %) | C/H atomic ratio | fa | Number average molecular weight (VPO) | Minimum molecular weight (GPC) | Maximum molecular weight (GPC) |
|---|---|---|---|---|---|---|---|---|---|
| tive) | | | Component B | 31 | 1.67 | 0.87 | 1,495 | — | 20,500 |
| | | | Component C | 36 | 1.87 | 0.90 | 2,540 | — | 37,000 |

TABLE 6

Spinning properties of pitches

| Pitch sample | Properties of pitch before spinning: Softening point (°C.) | Properties of pitch before spinning: Component C (wt. %) | Spinning conditions: Temp. (°C.) | Spinning conditions: Speed (m/min) | Spinning conditions: Spinning time (min.) | Breaking frequency (time/10 mins.) | Diameter of the fiber (average value) (μ) | Properties of pitch after spinning: Softening point (°C.) | Properties of pitch after spinning: Component C (wt. %) |
|---|---|---|---|---|---|---|---|---|---|
| Sample 9 (comparative) | 340 | 12 | 405 | 300 | 10 | more than 20 | 15.1 | — | — |
| | | | | | 60 | " | 17.6 | 354 | 15 |
| Sample 10 (comparative) | 329 | 36 | 395 | 300 | 10 | 5 | 11.9 | — | — |
| | | | | | 60 | 18 | 14.2 | 342 | 41 |

EXAMPLE 4

50 g of Pitch Sample 1 obtained in Example 2 was divided into four components, i.e. components O, A, B and C by the separation with solvents, i.e. n-heptane, benzene and quinoline. 10 wt. % component O and 30 wt. % powdery component A previously weighed so that the total amount of the synthetic pitch would be 20.0 g and that the proportion of the components would be within the range of the present invention were charged in a small glass mixing vessel having an internal volume of about 50 ml which vessel was provided with stirring blades. The temperature was elevated to 250° C. at a rate of 5° C./min. while the whole was stirred at 60 rpm. in a temperature region ranging from the melting point to 250° C. under nitrogen gas atmosphere. Then, the mixture was stirred at 60 rpm. at 250° C. for 30 minutes and allowed to cool. 30 wt. % of powdery component B was added to the mixture and the temperature was elevated to 300° C. in the same manner as above. The whole was stirred at 60 rpm. at 300° C. for 60 minutes and then allowed to cool. 30 wt. % of powdery component C was added to the mixture and the temperature was elevated to 360° C. at a rate of 5° C./min. under stirring at 60 rpm. The mixture was stirred at 60 rpm. at 360° C. for 60 minutes and then allowed to cool to obtain a synthetic pitch. The synthetic pitch had a softening point of 254° C., specific gravity of 1.34, carbon content of 94.0% and hydrogen content of 4.6 wt. %. It was observed by means of a polarized light microscope to reveal that it was a 100% optically anisotropic pitch.

The synthetic pitch was again fractionated into components O, A, B and C and the components were analyzed to obtain characteristics shown in Table 7.

The synthetic pitch was spun by means of the same spinning device having a nozzle of a diameter of 0.5 mm as in Example 2 under a nitrogen pressure of less than 200 mmHg. Thin pitch fibers could be obtained at a speed of 500 m/min. continuously for a long period of time with only a low breaking frequency of the fibers. Spinning properties of the pitch are shown in Table 8. The synthetic pitch will be referred to as Sample 11. Pitch fibers obtained from the synthetic pitch was used in Example 5.

COMPARATIVE EXAMPLE 6

Components O, A, B and C fractionated from a sample pitch as Sample 1 in Example 2 were used as the starting materials. Those four components were mixed together in a proportion of 20 wt. % component O, 10 wt. % component A, 40 wt. % component B and 30 wt. % component C in the same manner as in Example 4 to obtain a synthetic pitch which was not covered by the range of the present invention. The synthetic pitch thus obtained had a softening point of 235° C. It was observed by means of a polarized light microscope to reveal that it was a pitch comprising an optically anisotropic phase containing about 15% of an optically isotropic phase to form a complicated structure. The synthetic pitch was spun by means of the same spinning device having a nozzle of a diameter of 0.5 mm as in Example 2. Even at a speed of 300 m/min., breaking frequency of the fibers were high and thin pitch fibers could not be obtained. The spinning properties of the pitch was shown in Table 9. the synthetic pitch will be referred to as Comparative Sample 12. The pitch fibers were used in Example 5.

TABLE 7

| Pitch sample | Mixing Conditions: Component | Mixing ratio (wt. %) | Characteristics of components of synthetic pitches: Constituents | Content (wt. %) | C/H atomic ratio | fa | Number average molecular weight (VPO) | Minimum molecular weight (GPC) | Maximum molecular weight (GPC) |
|---|---|---|---|---|---|---|---|---|---|
| Sample 11 | Component O | 10 | Component O | 9 | 1.39 | 0.84 | 422 | 170 | — |
| | Component A | 30 | Component A | 32 | 1.47 | 0.87 | 528 | — | 1,940 |
| | Component B | 30 | Component B | 28 | 1.71 | 0.87 | 1,130 | — | 7,400 |
| | Component C | 30 | Component C | 31 | 1.90 | 0.92 | 1,420 | — | 19,500 |

TABLE 8

| Pitch sample | Properties of pitch before spinning: Softening point (°C.) | Component C (wt. %) | Spinning conditions: Temp. (°C.) | Speed (m/min) | Spinning time (min.) | Breaking frequency (time/10 mins.) | Diameter of the fiber (average value) (μ) | Properties of pitch after spinning: Softening point (°C.) | Component C (wt. %) |
|---|---|---|---|---|---|---|---|---|---|
| Sample 11 (present invention) | 256 | 31 | 340 | 500 | 10 | less than 1 | 7.5 | — | — |
| | | | | | 60 | " | 7.0 | — | — |
| | | | | | 80 | " | 8.4 | 257 | 31 |

TABLE 9

| Pitch sample | Properties of pitch before spinning: Softening point (°C.) | Component C (wt. %) | Spinning conditions: Temp. (°C.) | Speed (m/min) | Spinning time (min) | Breaking frequency (time/10 mins.) | Diameter of the fiber (average value) (μ) | Properties of pitch after spinning: Softening point (°C.) | Component C (wt. %) |
|---|---|---|---|---|---|---|---|---|---|
| Sample 12 (comparative) | 235 | 31 | 330 | 300 | 10 | 6 | 12.3 | — | — |
| | | | | | 60 | 10 | 15.1 | 236 | 31 |

EXAMPLE 5

The pitch fibers obtained by spinning the pitches in Examples 2–4 and Comparative Examples 1–6 were subjected to the infusibilization treatment at 240° C. in oxygen atmosphere for 30 minutes, then heated to 1,500° C. at a rate of 30° C./min. in nitrogen gas and allowed to cool to obtain carbon fibers. Characteristics of the carbon fibers are summarized in Table 10.

TABLE 10

| Pitch sample | Spinning time (min.) | Characteristics of carbon fibers prepared from optically anisotropic pitches: Characteristics of carbon fibers (carbonized at 1500° C.; average of 16 samples): Diameter (μ) | Tensile strength (GPa) | Modulus in tension ($10^2$ GPa) |
|---|---|---|---|---|
| Sample 1 (present invention) | 10 | 7.6 | 4.0 | 3.4 |
| | 60 | 6.7 | 3.4 | 3.5 |
| | 180 | 8.6 | 3.2 | 2.7 |
| Sample 2 (present invention) | 10 | 6.3 | 3.8 | 3.5 |
| | 60 | 8.8 | 3.1 | 2.4 |
| | 120 | 10.5 | 3.2 | 2.4 |
| Sample 4 (present invention) | 10 | 8.4 | 2.4 | 2.5 |
| | 60 | 7.2 | 2.7 | 2.7 |
| | 180 | 9.3 | 2.6 | 2.3 |
| Sample 5 (present invention) | 10 | 8.4 | 3.9 | 3.3 |
| | 60 | 8.5 | 3.7 | 3.4 |
| | 180 | 9.9 | 3.2 | 2.3 |

TABLE 10-continued

| Pitch sample | Spinning time (min.) | Characteristics of carbon fibers prepared from optically anisotropic pitches: Characteristics of carbon fibers (carbonized at 1500° C.; average of 16 samples): Diameter (μ) | Tensile strength (GPa) | Modulus in tension ($10^2$ GPa) |
|---|---|---|---|---|
| Sample 6 (present invention) | 10 | 10.2 | 2.4 | 2.7 |
| | 60 | 9.4 | 2.9 | 2.2 |
| | 120 | 11.9 | 2.1 | 2.2 |
| Sample 11 (present invention) | 10 | 7.5 | 3.8 | 3.4 |
| | 60 | 7.0 | 3.3 | 3.3 |
| | 180 | 8.4 | 3.3 | 2.8 |
| Sample 3 (comparative) | 10 | 15.3 | 1.3 | 1.6 |
| | 60 | 17.1 | 1.1 | 1.7 |
| Sample 7 (comparative) | 10 | 12.7 | 1.4 | 2.2 |
| | 60 | 14.1 | 1.3 | 2.1 |
| Sample 9 (comparative) | 10 | 15.1 | 0.9 | 0.7 |
| | 60 | 17.6 | 0.6 | 0.6 |
| Sample 10 (comparative) | 10 | 11.9 | 1.3 | 1.8 |
| | 60 | 14.2 | 1.0 | 1.4 |
| Sample 12 (comparative) | 10 | 12.3 | 1.4 | 1.7 |
| | 60 | 15.1 | 1.1 | 1.4 |

Having thus described the invention, what is desired to be protected by Letters Patent is presented by the following appended claims.

What is claimed is:

1. An improved spinnable optically anisotropic carbonaceous pitch having above about 90% of an optically anisotropic phase and a softening point in the range of about 230° C. to about 320° C., said pitch comprising:

(a) about 2 to 20 percent by weight of a first n-heptane-soluble component, said first component having a carbon-hydrogen atomic ratio of at least 1.3, a ratio of carbon atoms in the aromatic structure to the total carbon atoms of at least 0.8, a number average molecular weight of greater than 1000 and a molecular weight of not less than 150;

(b) about 15 to 45 percent by weight of a second n-heptane-insoluble and benzene-soluble component, said second component having a carbon-hydrogen atomic ratio of at least 1.4, a ratio of carbon atoms in the aromatic structure to the total carbon atoms of at least 0.8, a number average molecular weight of no greater than 2000 and a molecular weight of no greater than 10,000;

(c) about 5 to 55 percent of a third benzene-insoluble quinoline-soluble component, said third component having a carbon-hydrogen atomic ratio of at least 1.5, a ratio of carbon atoms in the aromatic structure to the total carbon atoms of at least 0.8, a number average molecular weight of no greater than 2000 and a molecular weight no higher than 10,000;

(d) about 20 to 70 percent by weight of a benzene-insoluble and a quinoline-insoluble fourth component having a carbon-hydrogen ratio of at least 1.8, a ratio of carbon atoms in the aromatic structure to the total carbon atoms of at least 0.85, a number average molecular weight of no greater than 3000 and a molecular weight no higher than 30,000.

2. The pitch of claim 1 wherein said first component comprises from about 5 to about 15 percent by weight of said pitch.

3. The pitch of claim 2 wherein said second component comprises from about 15 to about 35 percent by weight of said pitch.

4. The pitch of claim 3 wherein said third component comprises from about 5 to about 40 percent by weight of said pitch.

5. The pitch of claim 4 wherein said fourth component comprises from about 25 to 65 percent by weight of said pitch.

6. The pitch of claim 1 wherein said first, second, third and fourth components have carbon-hydrogen atomic ratios in the range of 1.3 to 1.6, 1.4 to 1.7, 1.5 to 1.9, and 1.8 to 2.3, respectively.

7. The pitch of claim 6 wherein said first, second, third and fourth components have number average molecular weights in the range of 250 to 700, 400 to 1000, 800 to 2000 and 1500 to 3000, respectively.

8. The pitch of claim 7 wherein said first component comprises 5 to 15 percent by weight, said second component comprises 15 to 35 percent by weight, said third component comprises 5 to 40 percent by weight and said fourth component comprises 25 to 65 percent by weight.

9. A carbonaceous pitch fiber having a softening point in the range of 230° C. to 320° C. and above about 90 percent of an optically anisotropic phase, said pitch fiber comprising:

(a) 2 to 20 weight percent of a first n-heptane-soluble component, said first component having a carbon-hydrogen atomic ratio of at least 1.3, a ratio of carbon atoms in the aromatic structure to the total carbon atoms of at least 0.8, a number average molecular weight of no greater than 1000 and a molecular weight of not less than 150;

(b) about 15 to 45 percent by weight of a second n-heptane-insoluble and benzene-soluble component, said second component having a carbon-hydrogen atomic ratio of at least 1.4, a ratio of carbon atoms in the aromatic structure to the total carbon atoms of at least 0.8, a number average molecular weight of no greater than 2000 and a molecular weight of no greater than 5000;

(c) about 5 to 55 percent of a third-benzene-insoluble quinoline-soluble component, said third component having a carbon-hydrogen atomic ratio of at least 1.5, a ratio of carbon atoms in the aromatic structure to the total carbon atoms of at least 0.8, a number average molecular weight of no greater than 2000 and a molecular weight no higher than 10,000; and (d) about 20 to 70 percent by weight of a benzene-insoluble and a quinoline-insoluble fourth component having a carbon-hydrogen ratio of at least 1.8, a ratio of carbon atoms in the aromatic structure to the total carbon atoms of at least 0.85, a number average molecular weight of no greater than 3000 and a molecular weight no higher than 30,000.

10. The pitch fiber of claim 9 wherein said first, second, third and fourth components have carbon-hydrogen ratios in the range of 1.3 to 1.6, 1.4 to 1.7, 1.5 to 1.9 and 1.8 to 2.3, respectively.

11. The pitch fiber of claim 10 wherein said first, second, third and fourth components have number average molecular weights in the range of 250 to 700, 400 to 1000, 800 to 2000 and 1500 to 3000, respectively.

12. The pitch fiber of claim 11 wherein said first component comprises 5 to 15 percent by weight, said second component comprises 15 to 35 percent by weight, said third component comprises 5 to 40 percent by weight and said fourth component comprises 25 to 65 percent by weight.

* * * * *